US010219096B2

(12) United States Patent
Volkmar et al.

(10) Patent No.: US 10,219,096 B2
(45) Date of Patent: Feb. 26, 2019

(54) SEAT-OPTIMIZED REPRODUCTION OF ENTERTAINMENT FOR AUTONOMOUS DRIVING

(71) Applicant: Bayerische Motoren Werke Aktiengesellschaft, Munich (DE)

(72) Inventors: Christian Volkmar, Munich (DE); Imre Csonka, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/100,358

(22) Filed: Aug. 10, 2018

(65) Prior Publication Data

US 2018/0352362 A1 Dec. 6, 2018

Related U.S. Application Data

(63) Continuation of application No. PCT/EP2017/051267, filed on Jan. 23, 2017.

(30) Foreign Application Priority Data

Feb. 12, 2016 (DE) ..... 10 2016 202 166

(51) Int. Cl.
*H04S 7/00* (2006.01)
*H04R 5/04* (2006.01)

(52) U.S. Cl.
CPC ..... *H04S 7/303* (2013.01); *H04R 5/04* (2013.01); *H04R 2499/13* (2013.01)

(58) Field of Classification Search
CPC ..... H04R 2499/13; H04R 5/04; H04S 7/303
(Continued)

(56) References Cited

U.S. PATENT DOCUMENTS 7,305,097 B2 * 12/2007 Rosen ..... H04S 7/30 381/119
2004/0156512 A1 8/2004 Parker
(Continued)

FOREIGN PATENT DOCUMENTS

DE 10 2006 051 229 A1 5/2008
DE 10 2015 103 392 A1 9/2015
EP 1 469 705 A2 10/2004

OTHER PUBLICATIONS

International Search Report (PCT/ISA/210) issued in PCT Application No. PCT/EP2017/051267 dated Feb. 6, 2018 with English translation (nine (9) pages).
(Continued)

*Primary Examiner* — Paul S Kim
(74) *Attorney, Agent, or Firm* — Crowell & Moring LLP

(57) ABSTRACT

A vehicle is provided having a passenger compartment with at least a front seat position in a front audio zone and at least a rear seat position in a rear audio zone. The vehicle includes at least left and right front speakers respectively in relation to the forward direction of the vehicle, which are arranged in front of the front seat position; left and right center speakers respectively, which are arranged in front of the rear seat position; a central front speaker which is arranged centrally in front of the front seat position; and a control unit which is designed to route signal portions of individual channels of a multi-channel audio signal to the speakers such that the multi-channel audio signal is spatially played back in the front and the rear audio zone based on the seat positions; wherein the front seat position is rotatable by 180 degrees.

20 Claims, 4 Drawing Sheets

(58) Field of Classification Search
USPC ..... 381/86
See application file for complete search history.

(56) References Cited

U.S. PATENT DOCUMENTS

| | | | |
|---|---|---|---|
| 2004/0228498 | A1 | 11/2004 | Sekine |
| 2006/0045291 | A1 | 3/2006 | Smith |
| 2015/0142245 | A1 | 5/2015 | Cuddihy et al. |

OTHER PUBLICATIONS

German-language Written Opinion (PCT/ISA/237) issued in PCT Application No. PCT/EP2017/051267 dated Feb. 6, 2018 (thirteen (13) pages).
German-language Search Report issued in counterpart German Application No. 102016202166.4 dated Sep. 8, 2016 with partial English translation (eleven (11) pages).
Ainlay et al., Producers & Engineering Wing Surround Sound Recommendations Committee, "Recommendations for Surround Sound Production", The National Academy of Recording Arts & Science, 2006, XP055220949, (68 pages).
Filo et al., "Design of Interior for a Self-Driving Car", Department of Product and Production Development, 2015, pp. 1-85, Gothenburg, Sweden, XP055436729 (95 pages).

* cited by examiner

| | L | R | C | Ls | Rs | LFE |
|---|---|---|---|---|---|---|
| Lf | X | | | | | |
| Rf | | X | | | | |
| Cf | | | X | | | |
| Lm | X | | | X | | |
| Rm | | X | | | X | |
| Cm | | | X | | | |
| Lr | | | | X | | |
| Rr | | | | | X | |
| ZBL | | | | | | X |
| ZBR | | | | | | X |

| | L | R | C | Ls | Rs | LFE |
|---|---|---|---|---|---|---|
| Lf | | | | X | | |
| Rf | | | | | X | |
| Cf | | | | X | X | |
| Lm | X | | | | | |
| Rm | | X | | | | |
| Cm | | | X | | | |
| Lr | | | | X | | |
| Rr | | | | | X | |
| ZBL | | | | | | X |
| ZBR | | | | | | X |

SEAT-OPTIMIZED REPRODUCTION OF ENTERTAINMENT FOR AUTONOMOUS DRIVING

CROSS REFERENCE TO RELATED APPLICATIONS

This application is a continuation of PCT International Application No. PCT/EP2017/051267, filed Jan. 23, 2017, which claims priority under 35 U.S.C. § 119 from German Patent Application No. DE 10 2016 202 166.4, filed Feb. 12, 2016, the entire disclosures of which are herein expressly incorporated by reference.

BACKGROUND AND SUMMARY OF THE INVENTION

The invention relates in general to the parallel reproduction of multichannel audio signals in different audio zones in a passenger compartment of a vehicle. In particular, the invention relates to automatic adaptation of individual audio zones for the reproduction of multichannel audio signals in the passenger compartment of the vehicle.

BACKGROUND OF THE INVENTION

The reproduction of audio signals in a surround sound audio signal format in a passenger compartment of a vehicle is known fundamentally. The aim is to facilitate a stereophonic acoustic impression (also stereophonic sound or surround sound) for the ear during the reproduction of sound recordings.

By way of example, surround sound 5.1 denotes a multichannel sound system in which sound signals are contained for three main loudspeakers including front left (left, L), front center (center, C) and front right (right, R), surround loudspeakers including rear left (Ls) and rear right (Rs) and a low-frequency loudspeaker (LFE, "Low Frequency Effects" or else "Low Frequency Enhancement") that together facilitate the surround sound experience for the listener. For equivalent surround reproduction at every seat in the passenger compartment of a vehicle, these 5.1 channels are distributed (routed) to different loudspeakers in the vehicle by intelligent mixing. The intended result of this is that a sound field compliant with ITU standard ITU-R BS.775 is produced for every occupant.

By way of example, DE 10 2006 051 229 A1 discloses a sound production system for a vehicle having multiple vehicle seats at different vehicle seat positions with a sound source for the parallel output of a multiplicity of different audio signals, with an amplifier device for amplifying the audio signals, with a multiplicity of midrange/high-frequency loudspeakers for the output of a respective amplified audio signal and with a processor device for correcting the audio signals, so that the audio signals are optimized for multiple vehicle seat positions.

FIG. 1 illustrates the known audio reproduction situation in a vehicle 1. In this case, 5.1 sound reproduction consistent with the prior art is depicted, as is achieved by application of a routing matrix, as shown in the table in FIG. 2.

Highly automated driving is gaining increasing maturity in prototype designs. Various scenarios are discussed in this case to improve seat comfort for the occupants in a vehicle, e.g., it is conceivable that when a journey is active the driver and the front seat passenger can rotate their seats to the interior. This allows a room situation for improved communication to be obtained for the occupants. A problem, however, is that in this altered room situation the driver and the front seat passenger locate the sound sources corresponding to the audio signals in an acoustically incorrect fashion, i.e., perceive them at the wrong location. This gives a confusing and sometimes very disturbing experience.

DISCLOSURE OF THE INVENTION

It is an object of the present invention to specify a solution to the problem described above.

The object is achieved by the respective features of the independent claims. Further exemplary embodiments and advantageous developments emerge from the respective dependent claims, the description and the drawings. In this case, features and details described in connection with the method naturally also apply in connection with the corresponding apparatus, and vice versa in each case.

A central concept of the invention is avoiding acoustic mislocation for driver and front seat passenger seats rotated to the interior by performing appropriate adaptation of the main sound field to suit the new situation. This achieves an equivalent reproduction response for every seat. Substantially, this is achieved by dynamic adaptation of the mix of the channels of the multichannel audio signal (audio mixing), for example, of a surround sound signal of a multichannel sound system.

An advantage of this invention is equivalent surround sound reproduction for two different driving situations: (a) nonautonomous driving, where all seats are arranged in the direction of travel; and (b) autonomous driving, where the driver/front seat passenger seats are arranged oppositely to the direction of travel. It should be noted that the applicability of situation (b) is naturally not limited to autonomous driving, but rather is likewise advantageous in any similar situation, for example in the case of a parked vehicle.

A first aspect of the invention relates to a method for routing signal components of individual channels (L, R, C, Ls, Rs, LFE) of a multichannel audio signal to multiple loudspeakers in a vehicle. The vehicle has at least one front seat position in a front audio zone and at least one rear seat position in a rear audio zone. The rear audio zone is arranged behind the front audio zone in the forward direction of the vehicle. Referenced to the forward direction, the vehicle has: at least one left front loudspeaker and one right front loudspeaker that are arranged in front of the front seat position; one left center loudspeaker and one right center loudspeaker that are arranged in front of the rear seat position; and a central front loudspeaker that is arranged centrally in front of the front seat position. The method involves:

(a) routing the signal components of the individual channels (L, R, C, Ls, Rs, LFE) of the multichannel audio signal to the loudspeakers, so that the multichannel audio signal is reproduced stereophonically in both the front and the rear audio zone. In that case, if the front seat position is directed in the forward direction of the vehicle, a left channel (L) is routed to the left front loudspeaker and the left center loudspeaker, a right channel is routed to the right front loudspeaker and the right center loudspeaker, a center channel (C) is routed to the central front loudspeaker, a left surround channel is routed to the left center loudspeaker, and a right surround channel is routed to the right center loudspeaker;

(b) sensing whether the front seat position has been rotated in the backward direction of the vehicle;

(c) if the front seat position is rotated in the backward direction (RR) of the vehicle, routing the left channel (L)

only to the left center loudspeaker, the right channel (R) only to the right center loudspeaker, the left surround channel (Ls) to the left front loudspeaker and the right surround channel (Rs) to the right front loudspeaker, and interrupting the routing of the center channel (C) to the central front loudspeaker.

If the front seat position is rotated in the backward direction of the vehicle, it is additionally possible for both the left surround channel (Ls) and the right surround channel (Rs) to be additionally routed to the central front loudspeaker.

A second aspect of the invention relates to a computer program that has a software means for performing a method for controlling a routing matrix for signal components of individual channels (L, R, C, Ls, Rs, LFE) of a multichannel audio signal to multiple loudspeakers in a vehicle according to the first aspect of the invention when the computer program is executed in a computer system of a control unit for controlling the routing matrix.

A third aspect of the invention relates to a vehicle having a passenger compartment having at least one front seat position in a front audio zone and having at least one rear seat position in a rear audio zone. The rear audio zone is arranged behind the front audio zone in the forward direction of the vehicle. The vehicle further has: referenced to the forward direction, at least one left front loudspeaker and one right front loudspeaker that are arranged in front of the front seat position; one left center loudspeaker and one right center loudspeaker that are arranged in front of the rear seat position; and a central front loudspeaker that is arranged centrally in front of the front seat position; a control unit that is set up to route signal components of individual channels (L, R, C, Ls, Rs, LFE) of a multichannel audio signal to the loudspeakers such that the multichannel audio signal is reproduced stereophonically in the front and in the rear audio zone. The control unit is set up so as, if the front seat position is rotated in the forward direction of the vehicle, to route a left channel (L) to the left front loudspeaker and the left center loudspeaker, a right channel (R) to the right front loudspeaker and the right center loudspeaker, a center channel (C) to the central front loudspeaker, a left surround channel (Ls) to the left center loudspeaker and a right surround channel (Rs) to the right center loudspeaker. According to the invention, the front seat position of the vehicle is rotatable through 180 degrees. The control unit is therefore further set up so as, if the front seat position is rotated in the backward direction of the vehicle, to route the left channel (L) only to the left center loudspeaker, the right channel (R) only to the right center loudspeaker, the center channel (C) no longer to the central front loudspeaker, the left surround channel (Ls) to the left front loudspeaker and a right surround channel (Rs) to the right front loudspeaker.

Preferably, the control unit is set up so as, if the front seat position is rotated in the backward direction of the vehicle, to route both the left surround channel and the right surround channel also to the central front loudspeaker.

Preferably, the vehicle further has a sensing device that is set up to sense the rotary position of the front seat position with reference to the forward direction of the vehicle and to make a rotary position signal representing the rotary position directly or indirectly available to the control unit to detect the rotary position.

In a particular embodiment, the front seat position and the rear seat position in the vehicle have a screen arranged between them. The screen is preferably set up such that a display content of the screen is visible both from the front seat position, if the front seat position is rotated in the backward direction of the vehicle, and from the rear seat position at the same time. Particularly preferably, the screen is a see-through (transparent) screen having active or passive organic light-emitting elements, what are known as OLEDs, as image elements.

Fundamentally, in all aspects of the invention, the multichannel audio signal may involve one of the known formats 5.1, 6.1 or 7.1 or else any future signal format. The principle described here is then transferrable as appropriate. In the case of the formats 5.1, 6.1 and 7.1 cited by way of example, the first digit "5", "6" or "7" relates to the number of audio channels (L, R, C, Ls, Rs) for reproduction, referenced to an audio zone, in each case on an assigned loudspeaker. The second digit "1" indicates the presence of a low-frequency audio effect channel (LFE) for reproduction on at least one subwoofer.

It should also be noted that the methods according to the invention can be applied not only in automotive applications but also to all other audio applications in which the hearing situation can be dynamically altered by rotation of seats through 180°. By way of example, the principle can also be transferred to a conference room situation if individual seats therein are likewise arranged so as to be rotatable through 180 degrees.

Preferred Exemplary Embodiments

Further advantages, features and details of the invention emerge from the description that follows in which an exemplary embodiment of the invention is described in detail with reference to the drawings. In this context, the features mentioned in the claims and in the description may each be essential to the invention individually per se or in any desired combination. Similarly, the features cited above and the features explained further herein can each be used per se or in multiples in any combinations. Functionally similar or identical parts or components are provided with the same reference signs to a certain extent. The terms "on the left," "on the right," "at the top" and "at the bottom" used in the description of the exemplary embodiments relate to the drawings in an orientation with a normally readable designation of the figures or normally readable reference signs. The embodiment shown and described is not intended to be understood as conclusive but rather has an exemplary character to explain the invention. The description serves to inform a person skilled in the art, and therefore circuits, structures and methods that are known in the description are not shown or explained in detail, so as not to make comprehension difficult.

Other objects, advantages and novel features of the present invention will become apparent from the following detailed description of one or more preferred embodiments when considered in conjunction with the accompanying drawings.

DETAILED DESCRIPTION OF THE DRAWINGS

Figures 1, 2:
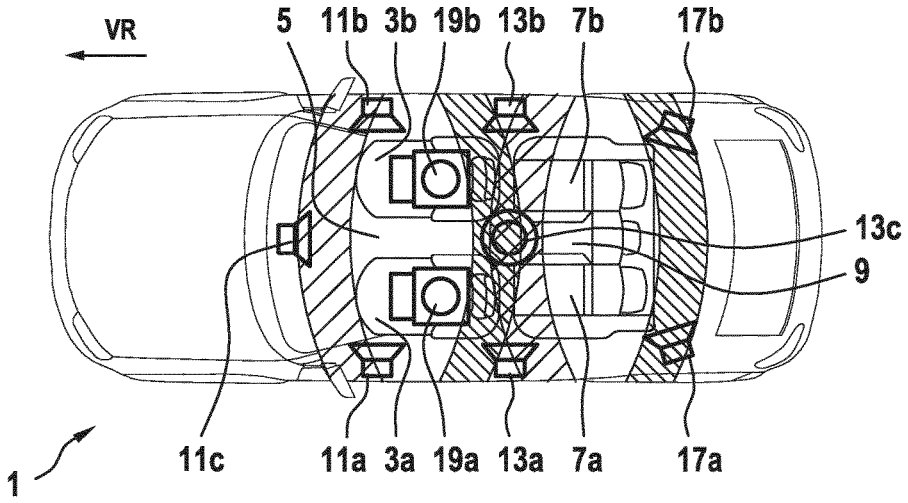
FIG. 1 shows a plan view of a vehicle having front and rear seat positions and multiple loudspeakers for reproducing a multichannel audio signal such that the front and rear seat positions each have an audio zone produced for them in which a passenger sitting therein is provided with a stereophonic acoustic impression that corresponds to the multichannel audio signal.
FIG. 2 shows a table as an exemplary embodiment of a routing matrix for the channels of a 5.1 surround sound multichannel audio signal, according to which the individual channels are routed to the loudspeakers in the vehicle of FIG. 1 so that the audio zones appropriate to the front and rear seats are produced.

FIG. 1 shows a plan view of a vehicle 1 having front seat positions 3*a*, 3*b* and rear seat positions 7*a*, 7*b* and also multiple loudspeakers 11*a*, 11*b*, 13*a*, 13*b*, 11*c*, 17*a*, 17*b*, 13*c*, 13*ca*, 13*cb* for reproducing a multichannel audio signal. The multichannel audio signal is reproduced on the loudspeakers in a manner known per se such that the front seat positions 3*a*, 3*b* and the rear seat positions 7*a*, 7*b* have an audio zone 5 and 9, respectively, produced for them. In each of the audio zones 5 and 9, a passenger sitting therein is provided with a stereophonic acoustic impression corresponding to the multichannel audio signal.

In this regard, FIG. 2 shows a table with a routing matrix for the channels of a 5.1 surround sound multichannel audio signal. According to the routing matrix, the individual channels of a 5.1 surround sound multichannel audio signal used as an example herein are routed to the individual loudspeakers of the vehicle 1. The 5.1 surround sound multichannel audio signal accordingly has the following channels:

- left channel (L),
- right channel (R),
- center channel (C),
- left surround channel (Ls),
- right surround channel (Rs), and
- a low-frequency effect channel (LFE).

The individual loudspeakers are:

- left front loudspeaker (Lf) 11*a* in the left front vehicle door or the left A-pillar,
- right front loudspeaker (Rf) 11*b* in the right front vehicle door or the right A-pillar,
- center front loudspeaker (Cf) 11*c* centrally in the dashboard,
- center left loudspeaker (Lm) 13*a* in the left rear vehicle door or vehicle side or the left B-pillar,
- center right loudspeaker (Rm) 13*b* in the right rear vehicle door or vehicle side or the right B-pillar,
- a center midpoint loudspeaker (Cm) 13*c* centrally in the vehicle roof lining,
- left rear loudspeaker (Lr) 17*a* in the left C-pillar or on the left in the parcel shelf,
- right rear loudspeaker (Rr) 17*b* in the right C-pillar or on the right in the parcel shelf, and
- two low-frequency effect loudspeakers, namely:
  - left central bass loudspeaker (ZBL) 19*a* beneath the left front seat 3*a*, and
  - right central bass loudspeaker (ZBR) 19*b* beneath the left front seat 3*b*.

To produce the front and rear audio zones 5, 9, signal components of the individual channels L, R, C, Ls, Rs, LFE of the multichannel audio signal are routed to the loudspeakers in the vehicle 1 according to the routing matrix in FIG. 2. As a result, the multichannel audio signal is reproduced stereophonically in each of the front and rear audio zones 5, 9 for the passengers therein. If the front seat position 3*a*, 3*b*, as depicted in FIG. 1, are oriented in the forward direction VR of the vehicle 1, the channels of the multichannel audio signal are routed according to the routing matrix of FIG. 2, as follows:

- the left channel L to the left front loudspeaker 11*a* and the left center loudspeaker 13*a*,
- the right channel R to the right front loudspeaker 11*b* and the right center loudspeaker 13*b*,
- the center channel C to the central front loudspeaker 11*c* and the center midpoint loudspeaker (Cm) 13*c*,
- the left surround channel Ls to the left center loudspeaker 13*a* and to the left rear loudspeaker 17*a*,
- the right surround channel Rs to the right center loudspeaker 13*b* and the right rear loudspeaker 17*b*,
- the low-frequency effect channel LFE to each of the left and right central bass loudspeakers (ZBL) 19*a* and (ZBR) 19*b*.

Figures 3, 4:
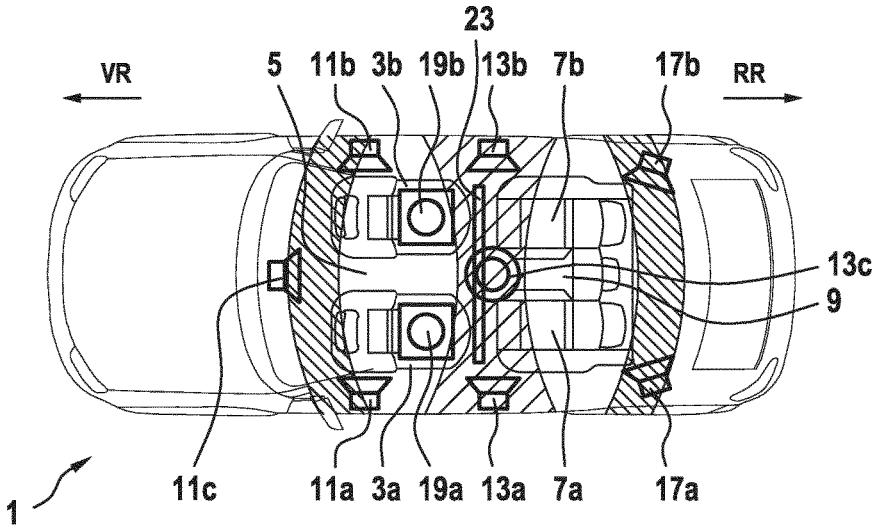
FIG. 3 shows a further plan view of the vehicle of FIG. 1 with the difference that the seats in the front seat positions are rotated through 180° and accordingly the hearing situation is changed in corresponding fashion for passengers in these seats, so that the routing of the channels of the multichannel audio signal to the loudspeakers is adapted, according to the invention, such that the passengers in the rotated seat positions are provided with a correct stereophonic acoustic impression.
FIG. 4 shows a table with the routing matrix, changed according to the invention, for routing the channels of the 5.1 surround sound multichannel audio signal to the loudspeakers in the vehicle of FIG. 1 with the changed seat configuration for the front seat positions shown in FIG. 3.

FIG. 3 now shows a further plan view of the vehicle 1 of FIG. 1 with the difference that the seats in the front seat positions 3*a*, 3*b* are each rotated through 180°. Accordingly, the hearing situation has changed for passengers in these seats. If the channels of the multichannel audio signal were to continue to be routed as described in connection with FIGS. 1 and 2, an irritating acoustic impression would arise for people in the rotated front seat positions 3*a*, 3*b*. Therefore, for this changed seat configuration, the routing of the channels of the multichannel audio signal to the loudspeakers of the vehicle 1 is adapted, according to the invention, such that the passengers in the rotated seat positions 3*a*, 3*b* are again provided with a correct stereophonic acoustic impression.

In this regard, FIG. 4 shows a table with the routing matrix, changed according to the invention, for the adapted routing of the channels of the—chosen as an example in this case—5.1 surround sound multichannel audio signal to the loudspeakers in the vehicle 1 with the changed seat configuration of the front seat positions 3*a*, 3*b* according to FIG. 3.

As soon as a suitable rotary position sensor for the front seat positions 3*a*, 3*b* has sensed that the front seat position 3*a*, 3*b* have been rotated through 180° in the backward direction RR of the vehicle 1, the routing of the channels of the multichannel audio signal to the loudspeakers is changed in accordance with the table in FIG. 4. To render the depiction more comprehensible, only the changes to the routing are described below.

If the front seat position 3*a*, 3*b*, as depicted in FIG. 3, is oriented in the backward direction RR of the vehicle 1, the routing of the following channels of the multichannel audio signal is changed in accordance with the routing matrix of FIG. 4, as follows:

the left channel L only to the left center loudspeaker 13*a*, the right channel R only to the right center loudspeaker 13*b*, the left surround channel Ls to the left front loudspeaker 11*a*, the right surround channel Rs to the right front loudspeaker 11*b*.

Further, the center channel C of the multichannel audio signal is no longer routed to the central front loudspeaker 11*c*.

Additionally, if the front seat position 3*a*, 3*b* is rotated in the backward direction RR of the vehicle 1, both the left surround channel Ls and the right surround channel (Rs) are additionally routed to the central front loudspeaker 11*c*. This does not necessarily have to occur, however, and is therefore optional, but may be advantageous.

Figure 5:
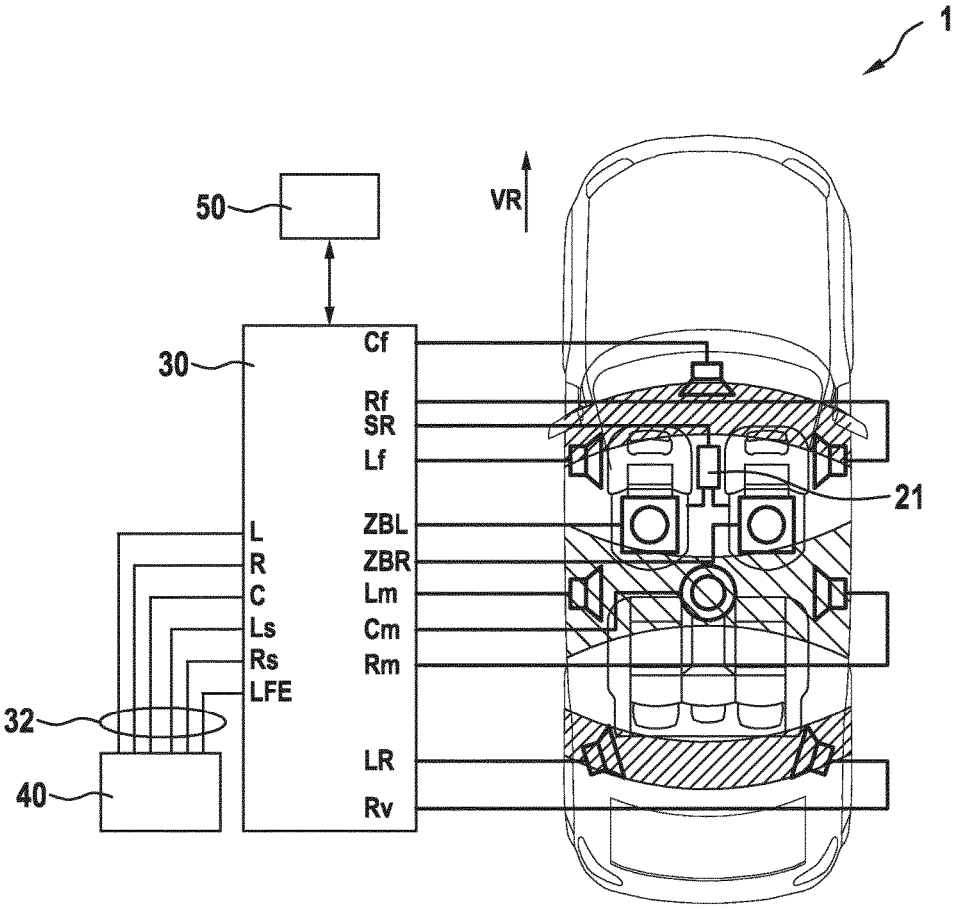
FIG. 5 illustrates a controller for the dynamic adaptation, according to the invention, of the routing of the channels of the multichannel audio signal according to the routing matrixes of FIGS. 2 and 4 for the vehicle of FIGS. 1 and 3.

FIG. 5 illustrates a controller 30 for the dynamic adaptation, according to the invention, of the routing of the channels of a multichannel audio signal 32 according to the routing matrixes of FIGS. 2 and 4 for the vehicle of FIGS. 1 and 3.

The vehicle 1 of FIG. 5 is identical to the vehicle depicted in FIGS. 1 and 3. As already noted elsewhere, the vehicle 1 has a sensing device 21 provided in it that is set up to sense the rotary position of the front seat position 3*a*, 3*b* with reference to the forward direction VR of the vehicle 1. This sensing device 21 is depicted in the vehicle 1 only in FIG. 5, but may accordingly likewise be provided in the embodiments of FIGS. 1 and 3. The sensing device 21 produces a rotary position signal SR representing the present rotary position and makes it directly or indirectly available to the control unit 30 to detect the rotary position.

The control unit 30 is connected to an audio signal source 40 that can provide a multichannel audio signal in 5.1, 6.1, 7.1 or a future format. The audio signal source 40 may, by way of example, be a digital radio receiver for receiving digital broadcast radio signals, for example, according to the planned DAB Surround Sound standard; DAB Surround Sound is supposed to allow 5.1 stereophonic sound through the combination of MPEG-1 Audio Layer 2 (DAB) or HE-AACv2 (DAB+) with MPEG Surround. The audio signal source 40 may, by way of example, also be a decoder that is set up to decode a digital coded signal stored on a digital storage medium, such as a CD-ROM, a DVD, a Blu-Ray disc, a memory card or a memory stick, for example. The audio signal source 40 then accordingly outputs signals in digital or analog form for the individual channels of the multichannel audio signal to a control device 30, which then routes the channels in appropriately weighted form to the loudspeakers of the vehicle, according to the routing matrixes described above, for reproduction. In this regard, FIG. 5 shows appropriate outputs for connection to the loudspeakers of the vehicle 1.

It should be noted that FIG. 3 is depicted in highly simplified form. A person skilled in the art will readily understand that the function of the control device 30 described herein can fundamentally be integrated into any entertainment system that is present in modern vehicles today. Such entertainment systems contain not only the necessary signal sources, such as a drive for recording and playback of CDs, DVDs or Blu-Ray discs, or an interface for USB memory sticks, or other memory card formats, or a short-range radio interface, such as Bluetooth, ZigBee or the like, for coupling to an audio signal source, such as a smartphone, but also the required technology for supplying the loudspeakers with an adequate analog audio signal. Therefore, such an entertainment system also preferably has the controller 30 described herein integrated in it or implemented by programming in it. At any rate, a user interface 50, for example, a graphical input/output interface for interaction with a user via a touch-sensitive screen (touch display), is provided for interaction with the user of the entertainment system and hence likewise of the controller 30 described herein.

The dynamic adaptation described herein for the routing matrix of a multichannel audio signal is particularly advantageous if a screen 23 is arranged in the vehicle 1, as indicated in FIG. 3, between the front seat positions 3*a*, 3*b* and the rear seat positions 7*a*, 7*b*. The screen may be embodied so as to be able to be folded out or folded down from the vehicle roof lining, for example.

Preferably, the screen is set up so that a display content of the screen 23 is visible, when the front seat positions 3*a*, 3*b* are directed in the backward direction RR of the vehicle 1, both from the front seat positions 3*a*, 3*b* and from the rear seat positions 7*a*, 7*b* at the same time. In this regard, a suggestion herein is to use a transparent screen whose screen content can be viewed from two sides. Alternatively, it is also possible for two screens to be used that are connected to another at the back, for example. In the example described herein, the screen 23 is embodied as a transparent screen that substantially consists of a front and a back transparent support layer and contains active or passive organic light-emitting elements, OLEDs, as image elements.

In the condition with the rotated front seat positions 3*a*, 3*b*, the stereophonic sound experience is mirrored left-right in the front audio zone 5 reconfigured (rotated) according to the invention. That is to say that a sound signal mixed to the left in the original sound mix is then perceived from the right in the front seat positions 3*a*, 3*b* rotated through 180°. For the rear seat positions 7*a*, 7*b*, nothing changes, i.e., the sound signal mixed to the left in the original sound mix continues to be correctly perceived from the left in the rear audio zone 9.

For this reason, the use of a transparent screen in the middle of the vehicle has even been found to be particularly advantageous. The reason is that with a transparent screen, when looking at the image from different sides, the image is perceived from one side to be mirrored right-left. Thus, when the screen is configured to match the hearing situations in the two audio zones 5, 9 for the occupants in the front seat positions 3*a*, 3*b* rotated through 180°, the screen content, which is likewise mirrored left-right, becomes consistent with the audio signal again. If two screens are used, the image on the screen for the front seat positions 3*a*, 3*b* rotated through 180° can accordingly be depicted in a manner mirrored left-right; this likewise fulfills the desired purpose.

Figure 6:
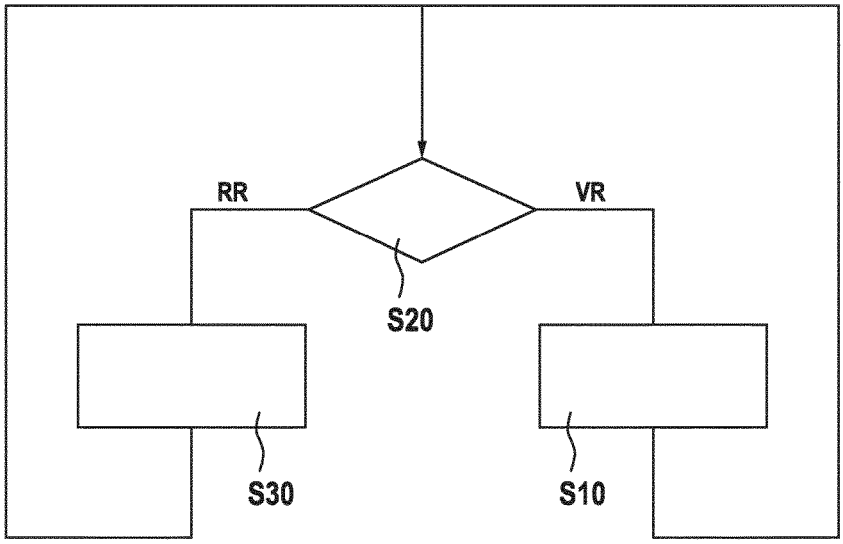
FIG. 6 illustrates a flowchart for a method according to the invention for dynamically adapting the routing matrix for routing channels of a multichannel audio signal for reproduction of a multichannel audio signal in a vehicle in response to a 180° rotation of front seat positions.

FIG. 6 illustrates a flowchart for a method according to the invention for dynamically adapting the routing matrixes according to FIGS. 2 and 4 for routing channels of a multichannel audio signal for reproduction of a multichannel audio signal in a vehicle 1, as shown in FIG. 1, in reaction to a 180° rotation of front seat positions, as shown in FIG. 3, and vice versa.

In a decision or checking step S20, it is regularly sensed whether the front seat position 3*a*, 3*b* is rotated in the forward direction (VR) or in the backward direction RR of the vehicle 1.

If, in step S20, it is found that the front seat positions 3*a*, 3*b* are rotated in the forward direction VR of the vehicle 1, the signal components of the individual channels of the multichannel audio signal 32 are routed to the loudspeakers in a step S10 such that the multichannel audio signal 32 is reproduced stereophonically in both the front and the rear audio zone 5, 9, as described in connection with FIGS. 1 and 2.

If, in step S20, it is found that the front seat positions 3*a*, 3*b* have been rotated in the backward direction RR of the vehicle 1, the signal components of the individual channels of the multichannel audio signal 32 are routed to the loudspeakers in a step S30 such that the multichannel audio signal 32 is reproduced stereophonically in each case, as described in connection with FIGS. 3 and 4.

Finally, it will once again be stressed that the 5.1 surround signal herein has been used merely as an example of a multichannel audio signal to describe the invention. It may likewise be a known 6.1 or 7.1 multichannel audio signal, to which the present invention can readily be transferred by a person skilled in the art.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for routing signal components of individual channels of a multichannel audio signal to multiple loudspeakers in a vehicle having at least one front seat position in a front audio zone of the vehicle and at least one rear seat position in a rear audio zone of the vehicle, wherein the rear audio zone is arranged behind the front audio zone in a forward direction of the vehicle, wherein, referenced to the forward direction, the vehicle has at least one left front loudspeaker and one right front loudspeaker that are arranged in front of the front seat position; one left center loudspeaker and one right center loudspeaker that are arranged in front of the rear seat position; and a central front loudspeaker that is arranged centrally in front of the front seat position; the method comprising:

routing the signal components of the individual channels of the multichannel audio signal to the loudspeakers, so that the multichannel audio signal is reproduced stereophonically in both the front and the rear audio zones, wherein when the front seat position is directed in the forward direction of the vehicle, a left channel is routed to the left front loudspeaker and the left center loudspeaker, a right channel is routed to the right front loudspeaker and the right center loudspeaker, a center channel is routed to the central front loudspeaker, a left surround channel is routed to the left center loudspeaker, and a right surround channel is routed to the right center loudspeaker; and sensing whether the front seat position has been rotated in a backward direction of the vehicle;

wherein, when the front seat position is rotated in the backward direction of the vehicle, the left channel is routed only to the left center loudspeaker, the right channel is routed only to the right center loudspeaker, the left surround channel is routed to the left front loudspeaker and the right surround channel is routed to the right front loudspeaker, and routing of the center channel to the central front loudspeaker is interrupted.

2. The method as claimed in claim 1, wherein, when the front seat position is rotated in the backward direction of the vehicle, the left surround channel and the right surround channel are also routed to the central front loudspeaker.

3. The method as claimed in claim 2, wherein the multichannel audio signal is a 5.1, 6.1 or 7.1 multichannel audio signal, wherein the first digit 5, 6 or 7 indicates a number of the individual channels for reproduction, referenced to the front audio zone or the rear audio zone, in each case on an assigned loudspeaker, and the second digit 1 indicates a presence of a low frequency audio effect channel for reproduction on at least one subwoofer.

4. The method as claimed in claim 1, wherein the multichannel audio signal is a 5.1, 6.1 or 7.1 multichannel audio signal, wherein the first digit 5, 6 or 7 indicates a number of the individual channels for reproduction, referenced to the front audio zone or the rear audio zone, in each case on an assigned loudspeaker, and the second digit 1 indicates a presence of a low frequency audio effect channel for reproduction on at least one subwoofer.

5. A non-transitory computer-readable medium storing a program which, when executed on a computer, causes the computer to perform a method for controlling a routing matrix for signal components of individual channels of a multichannel audio signal to multiple loudspeakers in a vehicle having at least one front seat position in a front audio zone of the vehicle and at least one rear seat position in a rear audio zone of the vehicle, wherein the rear audio zone is arranged behind the front audio zone in a forward direction of the vehicle, wherein, referenced to the forward direction, the vehicle has at least one left front loudspeaker and one right front loudspeaker that are arranged in front of the front seat position; one left center loudspeaker and one right center loudspeaker that are arranged in front of the rear seat position; and a central front loudspeaker that is arranged centrally in front of the front seat position, the method comprising:

routing the signal components of the individual channels of the multichannel audio signal to the loudspeakers, so that the multichannel audio signal is reproduced stereophonically in both the front and the rear audio zones, wherein when the front seat position is directed in the forward direction of the vehicle, a left channel is routed to the left front loudspeaker and the left center loudspeaker, a right channel is routed to the right front loudspeaker and the right center loudspeaker, a center channel is routed to the central front loudspeaker, a left surround channel is routed to the left center loudspeaker, and a right surround channel is routed to the right center loudspeaker; and sensing whether the front seat position has been rotated in a backward direction of the vehicle;

wherein, when the front seat position is rotated in the backward direction of the vehicle, the left channel is routed only to the left center loudspeaker, the right channel is routed only to the right center loudspeaker, the left surround channel is routed to the left front loudspeaker and the right surround channel is routed to the right front loudspeaker, and routing of the center channel to the central front loudspeaker is interrupted.

6. The non-transitory computer-readable medium as claimed in claim 5, wherein, when the front seat position is rotated in the backward direction of the vehicle, the left surround channel and the right surround channel are also routed to the central front loudspeaker.

7. The non-transitory computer-readable medium as claimed in claim 5, wherein the multichannel audio signal is a 5.1, 6.1 or 7.1 multichannel audio signal, wherein the first digit 5, 6 or 7 indicates a number of the individual channels for reproduction, referenced to the front audio zone or the rear audio zone, in each case on an assigned loudspeaker, and the second digit 1 indicates a presence of a low frequency audio effect channel for reproduction on at least one subwoofer.

8. A vehicle having a passenger compartment including at least one front seat position in a front audio zone and at least one rear seat position in a rear audio zone, wherein the rear audio zone is arranged behind the front audio zone in a forward direction of the vehicle, the vehicle comprising:

referenced to the forward direction, at least one left front loudspeaker and one right front loudspeaker that are arranged in front of the front seat position; one left center loudspeaker and one right center loudspeaker that are arranged in front of the rear seat position; and a central front loudspeaker that is arranged centrally in front of the front seat position; and a control unit that is set up to route signal components of individual channels of a multichannel audio signal to the loudspeakers such that the multichannel audio signal is reproduced stereophonically in the front audio zone and in the rear audio zone;

wherein, when the front seat position is directed in the forward direction of the vehicle, the control unit routes a left channel to the left front loudspeaker and the left center loudspeaker, a right channel to the right front loudspeaker and the right center loudspeaker, a center channel to the central front loudspeaker, a left surround channel to the left center loudspeaker and a right surround channel to the right center loudspeaker, wherein the front seat position is rotatable through 180 degrees, and wherein, when the front seat position is rotated in the backward direction of the vehicle, the control unit routes the left channel only to the left center loudspeaker, the right channel only to the right center loudspeaker, the center channel no longer to the central front loudspeaker, the left surround channel to the left front loudspeaker and a right surround channel to the right front loudspeaker.

9. The vehicle as claimed in claim 8, wherein, when the front seat position is rotated in the backward direction of the vehicle, the control unit routes both the left surround channel and the right surround channel also to the central front loudspeaker.

10. The vehicle as claimed in claim 9, further comprising:

a sensing device that senses a rotary position of the front seat position with reference to the forward direction of the vehicle and to make a rotary position signal representing the rotary position directly or indirectly available to the control unit to detect the rotary position.

11. The vehicle as claimed in claim 9, wherein the front seat position and the rear seat position have a screen arranged between them that is set up such that a display content of the screen, when the front seat position is rotated in the backward direction of the vehicle, is visible both from the front seat position and from the rear seat position at a same time.

12. The vehicle as claimed in claim 9, wherein the multichannel audio signal is a 5.1, 6.1 or 7.1 multichannel audio signal, wherein the first digit 5, 6 or 7 indicates a number of audio channels for reproduction, referenced to the front audio zone or the rear audio zone, in each case on an assigned loudspeaker and the second digit 1 indicates a presence of a low frequency audio effect channel for reproduction on at least one subwoofer.

13. The vehicle as claimed in claim 8, further comprising:

a sensing device that senses a rotary position of the front seat position with reference to the forward direction of the vehicle and to make a rotary position signal representing the rotary position directly or indirectly available to the control unit to detect the rotary position.

14. The vehicle as claimed in claim 13, wherein the front seat position and the rear seat position have a screen arranged between them that is set up such that a display content of the screen, when the front seat position is rotated in the backward direction of the vehicle, is visible both from the front seat position and from the rear seat position at a same time.

15. The vehicle as claimed in claim 13, wherein the multichannel audio signal is a 5.1, 6.1 or 7.1 multichannel audio signal, wherein the first digit 5, 6 or 7 indicates a number of audio channels for reproduction, referenced to the front audio zone or the rear audio zone, in each case on an assigned loudspeaker and the second digit 1 indicates a presence of a low frequency audio effect channel for reproduction on at least one subwoofer.

16. The vehicle as claimed in claim 8, wherein the front seat position and the rear seat position have a screen arranged between them that is set up such that a display content of the screen, when the front seat position is rotated in the backward direction of the vehicle, is visible both from the front seat position and from the rear seat position at a same time.

17. The vehicle as claimed in claim 16, wherein the multichannel audio signal is a 5.1, 6.1 or 7.1 multichannel audio signal, wherein the first digit 5, 6 or 7 indicates a number of audio channels for reproduction, referenced to the front audio zone or the rear audio zone, in each case on an assigned loudspeaker and the second digit 1 indicates a presence of a low frequency audio effect channel for reproduction on at least one subwoofer.

18. The vehicle as claimed in claim 16, wherein the screen is a see-through screen having active or passive organic light emitting elements.

19. The vehicle as claimed in claim 18, wherein the multichannel audio signal is a 5.1, 6.1 or 7.1 multichannel audio signal, wherein the first digit 5, 6 or 7 indicates a number of audio channels for reproduction, referenced to the front audio zone or the rear audio zone, in each case on an assigned loudspeaker and the second digit 1 indicates a presence of a low frequency audio effect channel for reproduction on at least one subwoofer.

20. The vehicle as claimed in claim 8, wherein the multichannel audio signal is a 5.1, 6.1 or 7.1 multichannel audio signal, wherein the first digit 5, 6 or 7 indicates a number of audio channels for reproduction, referenced to the front audio zone or the rear audio zone, in each case on an assigned loudspeaker and the second digit 1 indicates a presence of a low frequency audio effect channel for reproduction on at least one subwoofer.

* * * * *